US009121584B2

(12) United States Patent
Santoro et al.

(10) Patent No.: US 9,121,584 B2
(45) Date of Patent: Sep. 1, 2015

(54) OPTICAL ASSEMBLY FOR AN END CAP OF A LIGHTING FIXTURE

(75) Inventors: Scott Santoro, Delta (CA); Steven William Johns, Vancouver (CA); Daniel Fortin, New Westminster (CA)

(73) Assignee: Koninklijke Philips N.V., Eindhoven (NL)

( * ) Notice: Subject to any disclaimer, the term of this patent is extended or adjusted under 35 U.S.C. 154(b) by 30 days.

(21) Appl. No.: 13/980,610

(22) PCT Filed: Jan. 12, 2012

(86) PCT No.: PCT/IB2012/050148
§ 371 (c)(1), (2), (4) Date: May 9, 2014

(87) PCT Pub. No.: WO2012/098480
PCT Pub. Date: Jul. 26, 2012

(65) Prior Publication Data

US 2014/0321121 A1 Oct. 30, 2014

Related U.S. Application Data

(60) Provisional application No. 61/435,239, filed on Jan. 21, 2011.

(51) Int. Cl.
*F21V 5/00* (2006.01)
*F21V 13/04* (2006.01)
*F21S 8/06* (2006.01)
*F21V 15/015* (2006.01)
*F21V 15/01* (2006.01)

(52) U.S. Cl.
CPC . *F21V 13/04* (2013.01); *F21S 8/06* (2013.01); *F21V 15/01* (2013.01); *F21V 15/015* (2013.01)

(58) Field of Classification Search
CPC ..... F21S 8/06; F21S 13/04; F21S 15/01; F21S 33/00
USPC ..... 362/260, 329, 368, 307
See application file for complete search history.

(56) References Cited

U.S. PATENT DOCUMENTS

| | | | | |
|---|---|---|---|---|
| 2,288,606 | A * | 7/1942 | Callahan | 362/224 |
| 5,245,518 | A * | 9/1993 | Aspenwall | 362/640 |
| 6,305,816 | B1 * | 10/2001 | Corcorran et al. | 362/147 |
| 2006/0050505 | A1 * | 3/2006 | McCarthy et al. | 362/219 |
| 2007/0183148 | A1 * | 8/2007 | Mayfield et al. | 362/223 |

* cited by examiner

*Primary Examiner* — Ali Alavi
(74) *Attorney, Agent, or Firm* — Meenakshy Chakravorty

(57) ABSTRACT

Disclosed is an apparatus for an optical assembly for an end cap (30) of a lighting fixture (10). The optical assembly includes an outer lens (50) and an inner lens (40) interior of the outer lens (50). The end cap (30) may be coupled to a lighting fixture main housing (12) and configured to enable light from a light source (18) within the main housing (12) to enter the end cap (30), be directed through the inner lens (40), and out the outer lens (50).

19 Claims, 6 Drawing Sheets

OPTICAL ASSEMBLY FOR AN END CAP OF A LIGHTING FIXTURE

TECHNICAL FIELD

The present invention is directed generally to an optical assembly. More particularly, various inventive methods and apparatus disclosed herein relate to an optical assembly for an end cap of a lighting fixture.

BACKGROUND

The utilization of end caps in lighting fixtures is generally known. End caps may be utilized to inter alia, enclose the end of a lighting fixture and/or help define the aesthetics of a lighting fixture. End caps may be utilized in a variety of lighting fixtures including, for example, suspended lighting fixtures. Such suspended lighting fixtures may be stand alone fixtures and/or may be modularly coupled to one or more additional lighting fixtures in an end to end manner. For example, some modular lighting fixture systems provide start/end lighting fixtures and intermediate lighting fixtures. The start/end lighting fixtures define a light exit opening that is generally open at one end and closed at an opposite end by an end cap. The intermediate lighting fixtures define a light exit opening that is generally open at two ends. Two start/end lighting fixtures and, optionally one or more intermediate fixtures, may be coupled to one another in an end to end manner to form a substantially continuous light exit opening. For example, the open end of a light exit opening of a start lighting fixture may be coupled to one open end of a light exit opening of an intermediate lighting fixture and the open end of a light exit opening of an end lighting fixture may be coupled to the other open end of the light exit opening of the intermediate lighting fixture.

End caps that are utilized in stand-alone and/or modular lighting fixtures are typically completely opaque. Moreover, the end caps typically define and/or border the termination point of the light exit opening of the lighting fixture(s). Accordingly, light from the main light source of the lighting fixture does not emanate from the end caps but instead mainly emanates from a main light exit opening between the end caps. While such end cap configurations may be functional, they may not be of a desired appearance and/or may not provide desired light output at the ends of a lighting fixture.

Thus, there is a need in the art to provide an end cap for a lighting fixture that includes an optical assembly having an outer lens and that enables light from the lighting fixture to exit through the outer lens. The outer lens of the end cap may optionally extend upward and outward from the main light exit opening and/or interface with the main light exit opening to create the appearance of a continuous light exit opening.

SUMMARY

The present disclosure is directed to inventive methods and apparatus for an end cap for a lighting fixture that includes an outer transparent and/or translucent portion to enable light from the lighting fixture to exit therethrough. For example, in some embodiments an end cap is provided that has an arcuate outer lens and an inner lens interior of and adjacent to the outer lens. The end cap may be coupled to a lighting fixture main housing and configured to enable light from a light source within the main housing to enter the end cap, be directed through the inner lens, and out the outer lens. Optionally, the outer lens may extend upward from a main light exit opening of the lighting fixture and/or interface with the main light exit opening to create the appearance of a continuous light exit opening.

Generally, in one aspect, a lighting fixture is provided that includes a main housing that supports a light source and defines a main housing light exit opening. A main housing lens is supported by the main housing across the main housing light exit opening. The lighting fixture also includes an end cap housing coupled to the main housing. The end cap housing supports an outer arcuate lens, an interior reflector, and an optionally substantially planar inner lens interposed between the outer arcuate lens and the interior reflector. The outer arcuate lens has an outer lens first end adjacent the main housing lens and an outer lens second end extending outwardly and upwardly from the outer lens first end. The inner lens has an inner lens first end adjacent and interior of the outer lens first end and an inner lens second end adjacent and interior of the outer lens second end. The reflector is positioned above and spaced from the inner lens. An interior opening is defined between the end cap and the main housing. The interior opening enables the passage of light from the light source into the space between the inner lens and the reflector.

In some embodiments, the interior opening is obstruction-free. In some embodiments. the inner lens generally defines a lower extent of the interior opening. In some embodiments. the reflector generally defines an upper extent of the interior opening.

In some embodiments. substantially all light from the light source incident upon the outer arcuate lens must first pass through the inner lens. The light source may be a fluorescent or an incandescent light source.

In some embodiments, the inner lens is at a thirty-five to fifty-five degree angle relative to the main housing lens. Also, the reflector may converge toward the inner lens as the reflector becomes more proximal the inner lens second end. In some embodiments, the end cap is separable from the main housing.

Generally, in another aspect, a lighting fixture is provided that includes a main housing that supports a light source and defines a main housing light exit opening. A main housing lens is supported by the main housing across the main housing light exit opening. An end cap housing is coupled to the main housing. The end cap housing supports an outer arcuate lens, an interior reflector, and an inner lens interposed between the outer arcuate lens and the interior reflector. The outer arcuate lens has an outer lens first end adjacent and substantially aligned with the main housing lens and an outer lens second end extending outwardly and upwardly from the outer lens first end. Any space present between the outer arcuate lens and the main housing lens is substantially free of opaque structure. The inner lens generally extends at approximately a twenty-five to seventy degree angle relative to the main housing lens. The interior reflector is positioned above and spaced from the inner lens. An interior opening is defined between the end cap housing and the main housing. The interior opening enables the passage of light from the light source into the space between the inner lens and the interior reflector.

In some embodiments, the inner lens and the interior reflector flank the interior opening. Also, substantially all light from the light source may be incident upon the outer arcuate lens must first pass through the inner lens.

In some embodiments, the inner lens is at a forty to fifty degree angle relative to the main housing lens. In some embodiments, at least one cross section of the outer arcuate lens forms a portion of a parabola.

In some embodiments the first end of the inner lens is substantially atop the first end of the outer arcuate lens. Also, the lighting fixture further may include an optical film atop the main housing lens.

Generally, in another aspect, an end cap for a lighting fixture is provided. The end cap includes a housing generally defining a first side and a second side opposite the first side. An outer arcuate lens is provided between the first side and the second side. An interior reflector is also provided between the first side and the second side and an inner lens is interposed between the outer arcuate lens and the interior reflector. The outer arcuate lens has an outer lens first end proximal a connection end of the end cap and an outer lens second end extending outwardly and upwardly from the outer lens first end. The inner lens is substantially planar and extends from adjacent the outer lens first end to adjacent the outer lens second end. The interior reflector is positioned above and spaced from majority of the inner lens. The inner lens and the interior reflector generally flank an interior opening in the connection end of the end cap.

The interior reflector may converge toward the inner lens as the interior reflector becomes more distal the interior opening. Also, in some embodiments, the inner lens is substantially atop the first end of the outer lens.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
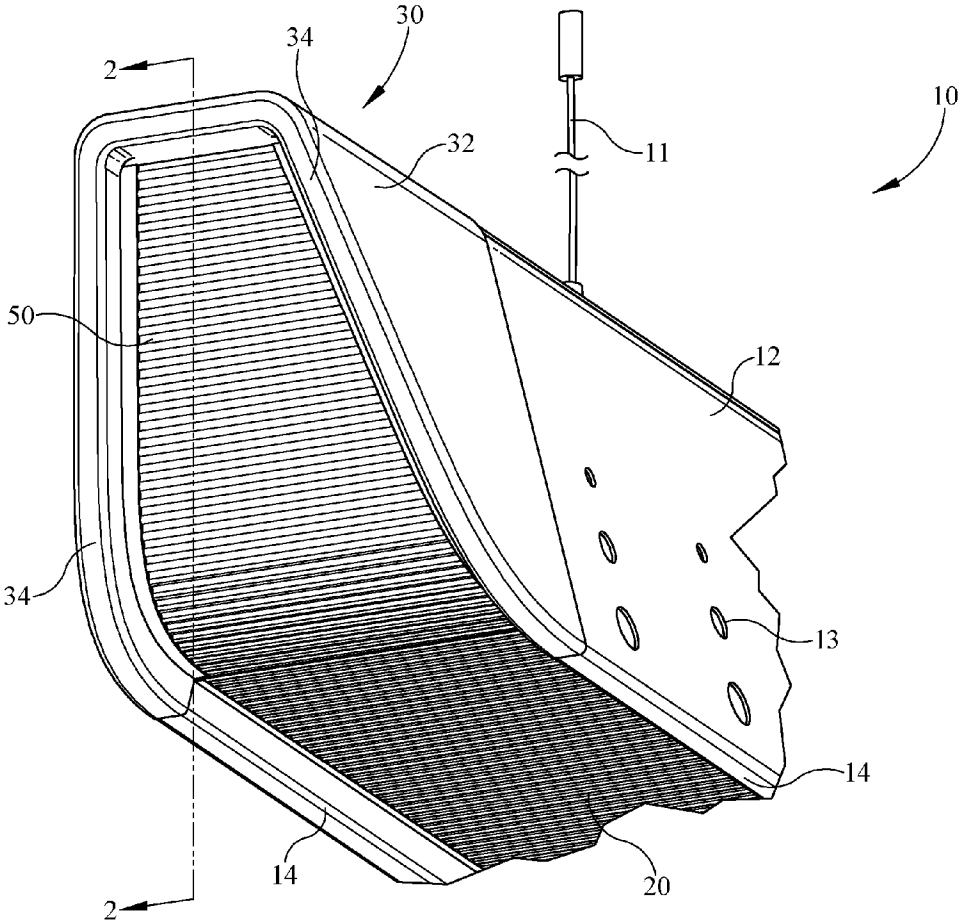
FIG. 1 illustrates an embodiment of a portion of a lighting fixture having an end cap.

The utilization of end caps in lighting fixtures is generally known in order to, inter alia, enclose the end of a lighting fixture and/or help define the aesthetics of a lighting fixture. End caps may be utilized in a variety of lighting fixtures including, for example, suspended stand alone lighting fixtures and suspended modular lighting fixtures. Known end caps may suffer from one or more drawbacks. For example, the end caps are typically completely opaque and/or define and/or border the termination point of the light exit opening of the lighting fixtures with which they are associated. While such end cap configurations may be functional, they may not be of a desired appearance and/or may not provide desired light output at the ends of a lighting fixture.

Thus, the Applicants have recognized a need to provide an end cap for a lighting fixture that includes an optical assembly having an outer lens and that enables light from the lighting fixture to exit through the outer lens. The outer lens of the end cap may optionally extend upward from the main light exit opening and/or interface with the main light exit opening to create the appearance of a continuous light exit opening. More generally, Applicants have recognized and appreciated that it would be beneficial to provide an optical assembly for an end cap of a lighting fixture.

In view of the foregoing, various embodiments and implementations of the present invention are directed to an optical assembly for an end cap of a lighting fixture. More particularly, various inventive methods and apparatus disclosed herein relate to an end cap having an arcuate outer lens and an inner lens interior of and adjacent to the outer lens. The end cap may be coupled to a lighting fixture main housing and configured to enable light from a light source within the main housing to enter the end cap, be directed through the inner lens, and out the outer lens.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. For example, throughout the Figures a fluorescent bulb is depicted installed within the lighting fixture. However, one of ordinary skill in the art, having had the benefit of the present disclosure will recognize and appreciate that in other implementations other light sources may additionally or alternatively be utilized in a lighting fixture. For example, an LED light source may be utilized instead of the fluorescent light source and may optionally be integrated with one or more of a heatsink, a LED driver, and/or optical lens provided over one or more of the LEDs of the LED light source. Moreover, descriptions of well-known apparatuses and methods may be omitted so as to not obscure the description of the representative embodiments. Such methods and apparatuses are clearly within the scope of the claimed invention.

Referring to FIG. 1, in one embodiment, a lighting fixture 10 includes a main housing 12 and an end cap housing 32 of an end cap 30. The depicted end cap housing 32 is coupled to the main housing 12 to provide the appearance of the main housing 12 and the end cap housing 32 being a cohesive unit. In alternative embodiments the main housing 12 and the end cap housing 32 may be constructed as a cohesive unit. Only a portion of the main housing 12 is shown. However, it is understood that the depicted main housing 12 is longitudinally extending and has an opposite end. In some embodiments the main housing 12 may be a standalone housing and may optionally have another end cap 30 at the opposite end thereof. In other embodiments the main housing 12 may be a modular housing that is coupleable to one or more additional housings (with similar or alternative configurations than housing 12) in an end to end manner. The modular housing most distal housing 12 may optionally be provided with another end cap 30 at an end thereof.

Main housing 12 generally supports other components of the lighting fixture 10 and may in some embodiments be formed of die-cast metal, sheet metal, and/or extruded aluminum. The main housing 12 has a generally trapezoidal cross section in the depicted embodiment but may have other cross sections in alternative embodiments. A plurality of openings 13 are provided through the main housing 12 for aesthetics and/or cooling purposes. A hanger wire 11 is depicted coupled to the main housing 12 and extending upwardly therefrom. Additional hanger wires 11 may be provided extending from other portions of the main housing 12. The hanger wire 11 may be coupled to a beam or other support to suspend the lighting fixture 10 in a desired installation location. Although hanger wire 11 is depicted in FIG. 1, one of ordinary skill in the art, having had the benefit of the present disclosure, will recognize and appreciate that other installation apparatus and methodologies may be utilized in conjunction with the lighting fixture 10.

The lighting fixture 10 also includes a main housing lens 20 provided over a longitudinally extending light exit opening defined by the main housing 12. The flange 14 generally defines the longitudinal edges of the light exit opening and supports the main housing lens 20 across the light exit opening. The flange 14 extends outwardly from the main housing lens 20, thereby giving the main housing lens 20 a recessed appearance relative to the flange 14. However, one of ordinary skill in the art, having had the benefit of the present disclosure will recognize and appreciate that in other embodiments other main housing lens configurations may be provided. For example, in some embodiments the main housing lens may be flush with respect to the surrounding housing.

End cap housing 32 generally supports other components of the end cap 30 and may optionally support other components of the lighting fixture 10. In some embodiments end cap housing 32 may be formed of sheet metal, extruded aluminum, and/or cast aluminum. End cap housing 32 has a generally trapezoidal cross section in the depicted embodiment but may have other cross sections in alternative embodiments. An arcuate outer lens 50 is visible in FIG. 1 and extends from adjacent the main housing lens 20 in an outward and upward direction. The arcuate outer lens 50 is flanked by a flange 34 of the end cap 30, thereby giving the arcuate outer lens 50 a recessed appearance relative to the flange 34. However, one of ordinary skill in the art, having had the benefit of the present disclosure will recognize and appreciate that in other embodiments other outer lens configurations may be provided. For example, in some embodiments the outer lens 50 may be flush with respect to the surrounding housing 32. The outer lens 50 lies across an end cap light exit opening generally defined by the end cap housing 32.

Figure 2:
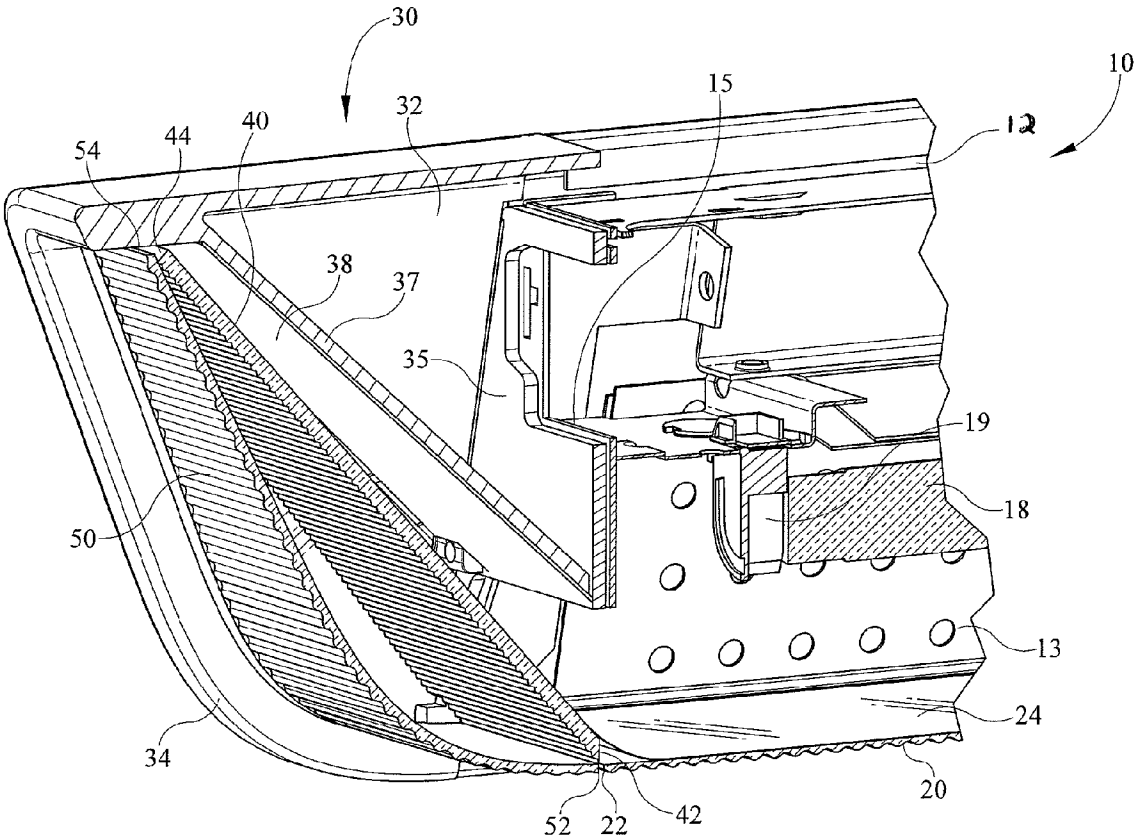
FIG. 2 illustrates a perspective section view of the embodiment of the lighting fixture of FIG. 1 taken along the section line 2-2 of FIG. 1.
Figure 3:
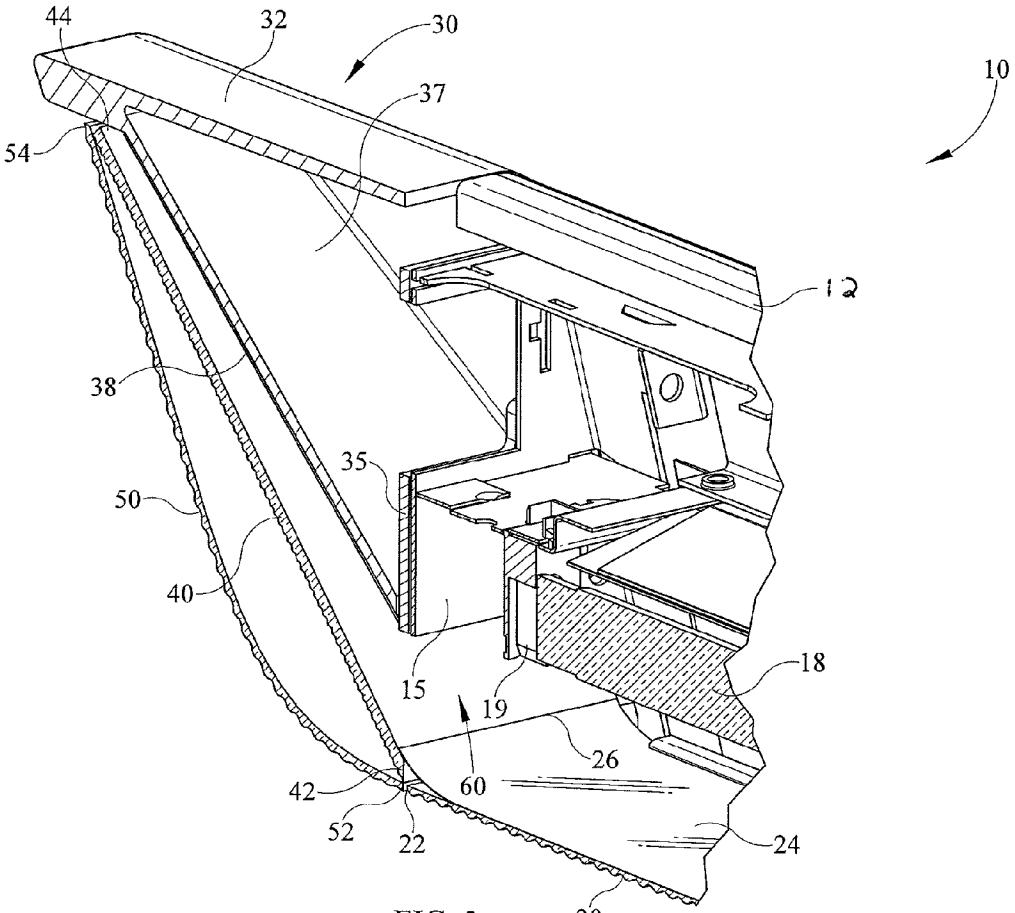
FIG. 3 illustrates an additional perspective section view of the embodiment of the lighting fixture of FIG. 1 taken along the section line 2-2 of FIG. 1.

Referring to FIGS. 2 and 3, perspective section views of the lighting fixture 10 taken along the section line 2-2 of FIG. 1 are shown. A fluorescent light source 18 is visible within the main housing 12 and extends substantially along the longitudinal length of the main housing 12. Light output from the fluorescent light source 18 is directed generally toward the main light exit opening and through the main housing lens 20. The fluorescent light source 18 is coupled to a fluorescent socket 19 which in turn is electrically coupled to an electrical ballast. A reflector may optionally be provided above and/or to the sides of the fluorescent light source 18 and may be positioned to direct light toward and through the main housing lens 20. Such a reflector may optionally have a highly reflective mirror finish. In alternative embodiments alternative reflector configurations may be utilized. For example, in some embodiments where an LED light source is used, the reflector may have a different shape and/or may have a diffuse surface.

An optical film 24 is depicted placed atop the main housing lens 20. In some embodiments the optical film 24 may be an optical film utilizing MesoOptics® technology available from Ledalite of Philips Lighting. In FIG. 2 and FIG. 3, it can be seen that the latitudinal end 26 of the optical film 24 extends beyond the latitudinal end 22 of the main housing lens 20. Moreover, the latitudinal end 26 extends through an opening 60 provided between the main housing 12 and the end cap housing 32. The latitudinal end 26 also extends beyond the lower end 42 of a substantially planar inner lens 40 and rests upon the inner lens 40. The extending of the optical film 24 beyond the main housing lens 20 and over the gap between the main housing lens 20 and the arcuate outer lens 50 may, for example, minimize the leaking of uncontrolled light out of the housing 12 through the gap. In alternative embodiments the optical film 24 may extend between the inner lens 40 and the outer lens 50. In some embodiments the optical film 24 may be omitted. In some of those embodiments any gap between the main housing lens 20 and the arcuate outer lens 50 may be minimal or substantially non-existent. In other of those embodiments the main housing lens 20 and the arcuate outer lens 50 may be integrally formed as a cohesive piece.

The arcuate outer lens 50 includes a lower end 52 that is positioned adjacent a latitudinal end 22 of main housing lens 20. An opposite upper end 54 of the arcuate outer lens 50 is positioned outward and upward from the lower end 52 and the latitudinal end 22. The depicted arcuate outer lens 50, when viewed in cross section, is generally in the form of a portion of a parabolic curve between the first end 52 and the second end 54. The upper end 54 of the outer lens 50 is adjacent the end cap housing 32 and may optionally be sealingly engaged against the housing utilizing, for example, a gasket and/or adhesive. The outer lens 50 rests on a lip that extends interiorly from the end cap flange 34. The outer lens 50 may be retained within the end cap housing 32 by the lip and/or by one or more gaskets, adhesives, mechanical clamps, and/or utilizing other retention methodologies. The depicted main housing lens 20 and outer arcuate lens 50 are frosted acrylic lenses that have ridges on outer surfaces thereof and are smooth on inner surfaces thereof. The lenses 20 and 50 are diffusing lenses. In alternative embodiments alternative configurations of main housing lens 20 and/or outer arcuate lens 50 may be utilized.

The inner lens lower end 42 is adjacent to and substantially aligned with the outer lens lower end 52. Likewise, the inner lens upper end 44 is adjacent to and substantially aligned with the outer lens upper end 54. The depicted inner lens 40 is generally planar. The spacing between the inner lens 40 and the outer lens 50 varies across the length of the inner lens 40 as a result of the curvature of the outer lens 50. The inner lens 40 may be retained within the housing by lip structure extending interiorly from the sidewalls of the housing 32 and/or structure extending in between the sidewalls of the housing 32. The depicted inner lens 40 is a non-frosted acrylic lens that has ridges on an outer surface thereof. The ridges of the inner lens 40 are more frequent and more linear than the generally rounded ridges of the outer lens 50 and the main housing lens 20. In alternative embodiments alternative configurations of inner lens 40 may be utilized. The depicted inner lens 40 is at approximately a forty-five degree angle relative to the main housing lens 20. Although a specific angle of inner lens 40 is depicted, one of ordinary skill in the art having had the benefit of the present disclosure will recognize that inner lens 40 may generally be at alternative angles in some embodiments to achieve desired optical characteristics.

Spaced apart from and located upward from the inner lens 40 is an angled end cap housing member 37 that extends between the sidewalls of the housing 32. The angled end cap housing member 37 generally extends upward from a gasket 35 to an upper portion of the end cap 32. A reflector 38 is provided substantially across the entire surface of the angled end cap housing member 37 that faces the inner lens 40. In some embodiments the reflector 38 may be supported via attachment to the opposite sidewalls of the end cap housing 32. The reflector 38 may alternatively or additionally be coupled to the angled end cap housing member 37 in some embodiments. The reflector 38 may be specular in some embodiments or may alternatively be a diffusing reflector in other embodiments. In some embodiments the reflector 38 may be a high reflectance white reflector. In some embodiments the end cap housing member 37 may be omitted. The depicted reflector 38 is at approximately a forty degree angle relative to the main housing lens 20 and it converges toward the inner lens 40 as it moves away from the main housing 12. Although a specific angle of reflector 38 is depicted, one of ordinary skill in the art having had the benefit of the present disclosure will recognize that reflector 38 may generally be at alternative angles in some embodiments to achieve desired optical characteristics.

The gasket 35 is coupled to a housing cross plate 15 of the main housing 12. The gasket 35 generally extends between, but is not coupled to, opposing sidewalls of end cap housing 32 and may provide for a good seal and/or contact between the end cap housing 32 and the main housing 12. The end cap housing 32 and the main housing 12 may optionally include interfacing structure to provide for attachment of the end cap housing 32 to the main housing 12. For example, one of the housings 12 or 32 may include male connection structure that is engagingly receivable in corresponding female structure of the other of housings 12 or 32. Also, for example, the end cap housing 32 may include a screw aperture through end cap housing member 37. The screw aperture may receive a screw therethrough that in turn engages the housing cross plate 15. One of ordinary skill in the art, having had the benefit of the present disclosure, will recognize and appreciate that other methods and structure may additionally or alternatively be utilized to couple the end cap 30 to the main housing 12. The gasket 35 and the housing cross plate 15 include corresponding openings therein that cooperatively define the interior opening 60. The interior opening 60 is generally provided between the inner lens lower end 42 and a corresponding end of the reflector 38. The interior opening 60 enables light from the fluorescent light source 18 to exit the main housing 12 and to enter the end cap 30.

In some embodiments, the main housing lens 20 and the optical film 24 may optionally be selectively offset vertically and horizontally into the end cap 30 by a user. The main housing lens 20 may be configured to flex upwardly at the latitudinal end 22 upon application of pressure thereto by a user. The main housing lens 20 may be offset vertically and horizontally into the end cap 30 by a user to help facilitate installation and/or removal of the main housing lens 20.

Figure 4A:
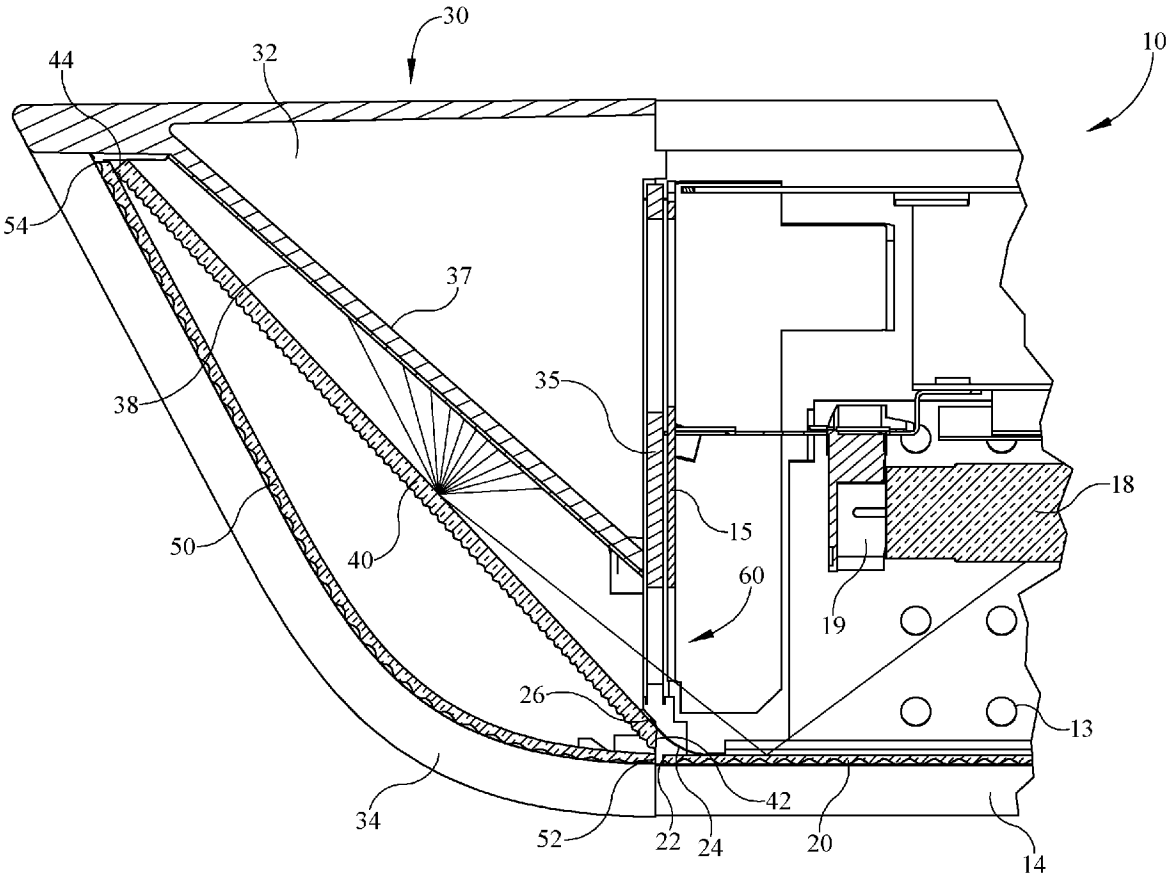
FIG. 4A illustrates a side section view of the embodiment of the lighting fixture of FIG. 1 taken along the section line 2-2 of FIG. 1; a ray trace of exemplary light rays that emanate from the light source of the lighting fixture is also illustrated.
Figure 4B:
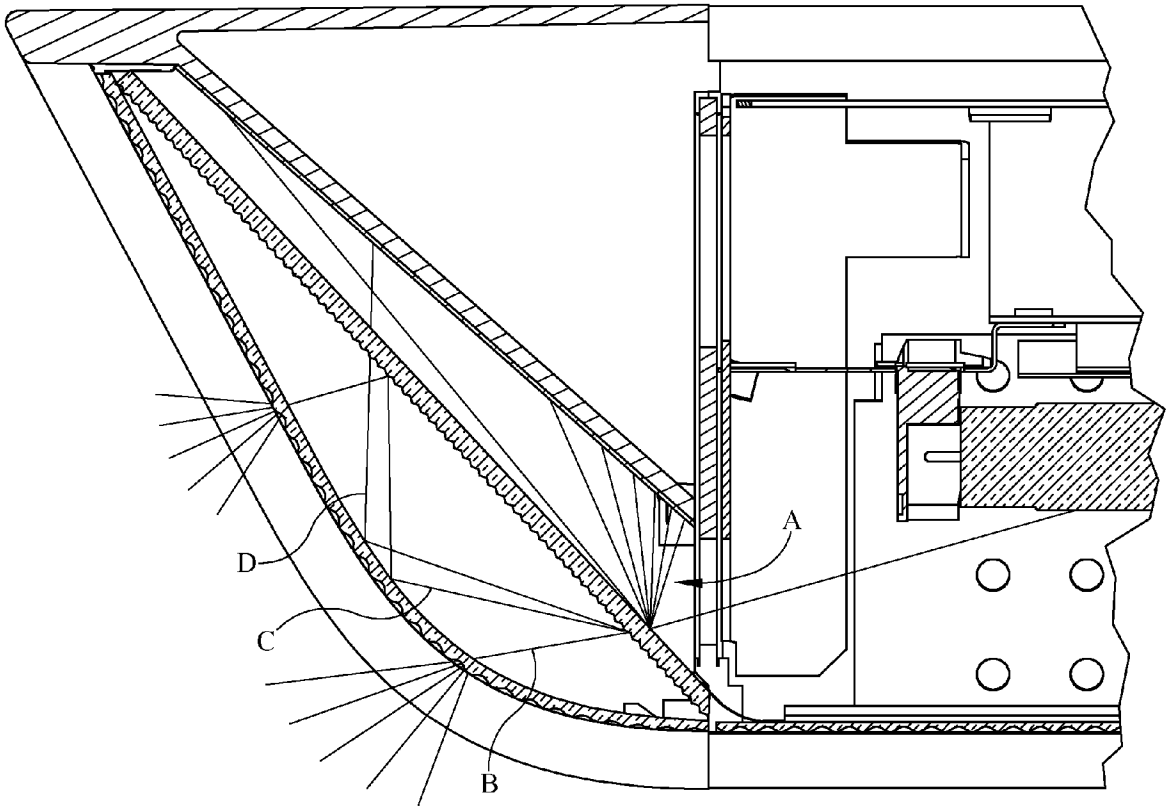
FIG. 4B illustrates a side section view of the embodiment of the lighting fixture of FIG. 1 taken along the section line 2-2 of FIG. 1; an additional ray trace of exemplary light rays that emanate from the light source of the lighting fixture is also illustrated.
Figure 4C:
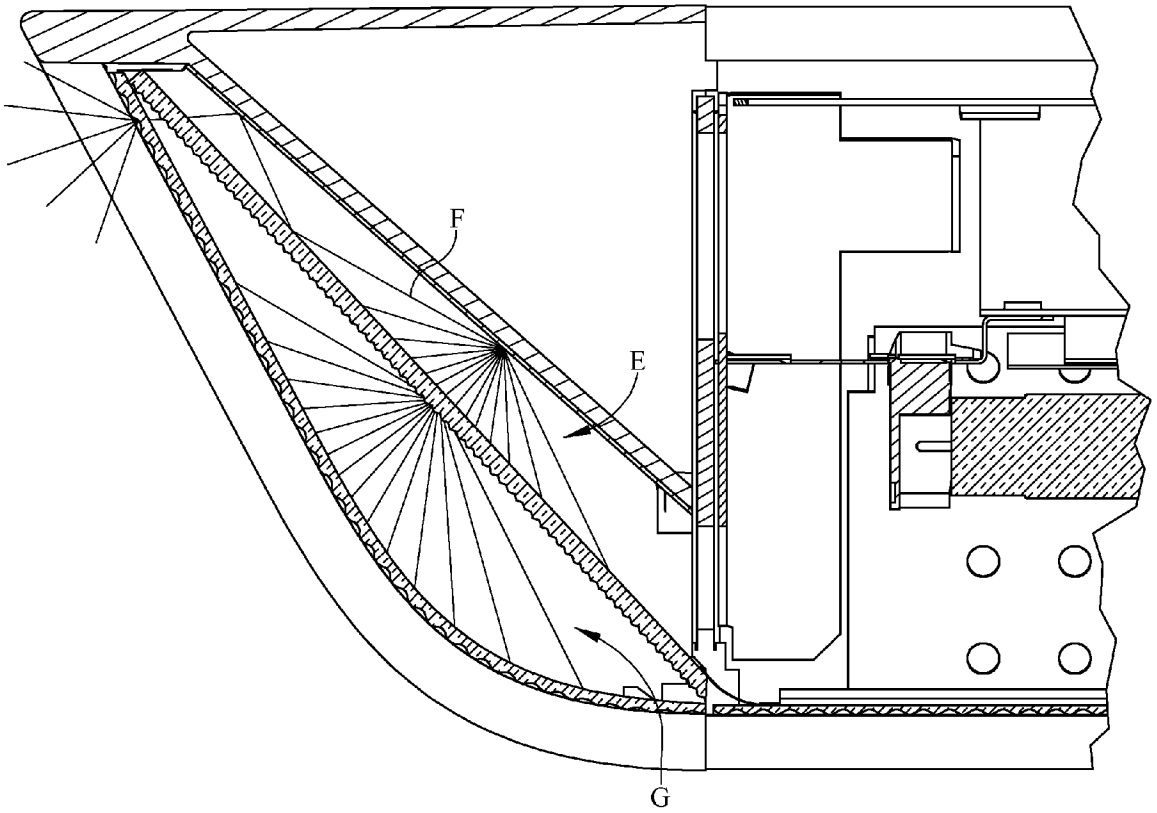
FIG. 4C illustrates a side section view of the embodiment of the lighting fixture of FIG. 1 taken along the section line 2-2 of FIG. 1; an additional trace of exemplary light rays that emanate from the light source of the lighting fixture is also illustrated.

Referring now to FIGS. 4A-4C, a side section view of the embodiment of the lighting fixture 10 taken along the section line 2-2 of FIG. 1 is illustrated. A ray trace of exemplary light rays that emanate from the fluorescent light source 18 of the lighting fixture 10 is also illustrated. The light rays presented in FIGS. 4A-4C are presented for exemplary purposes. It is understood that other light rays will be emitted by the fluorescent light source 18 that will enter the end cap 30 and behave differently as they contact one or more aspects of the optical assembly of the end cap 30. Moreover, it is understood that many of the light rays that are emitted by the fluorescent light source 18 will be directed through the main housing lens 20. For the sake of clarity, the light rays are not shown as they are transmitted through and/or internally reflected within, the lenses 40 and 50. Also, reference numbering related to lighting fixture 10 is provided in FIG. 4A, but is omitted in FIGS. 4B and 4C for clarity. It is understood that FIGS. 4B and 4C present the same view of the lighting fixture 10 as FIG. 4A and numbering of the lighting fixture 10 in such Figures would be the same.

Generally speaking, some of the light output from the fluorescent light source 18 may enter the end cap 30 via the interior opening 60 and be refracted through the inner lens 40 and then transmitted through the outer lens 50. Other light output may be internally or otherwise reflected by the inner lens 40, further reflected by the reflector 38, and then refracted through the inner lens 40 and transmitted through the outer lens 50. The refraction through and/or reflection by the inner lens 40 and optional further reflection by the reflector 38 may help distribute light output over the entirety of the outer lens 50.

Referring to FIG. 4A, a ray trace is provided of one or more light rays that are emitted from fluorescent light source 18. The light rays are reflected by main housing lens 20 as a result of reflection off the interior planar surface thereof and/or total internal reflection and directed through the interior opening 60 toward the inner lens 40. The angle of the light rays incident upon the inner lens 40 are such that they are reflected off the interior planar surface of inner lens 40 and directed upward toward the reflector 38.

Referring now to FIG. 4C, one or more of the light rays are depicted after having been directed upward to the reflector 38 and reflected and diffused by the reflector 38. The light rays generally indicated by reference letter E are reflected off of the reflector 38 and diffused back toward the inner lens 40. Some of those light rays are refracted through and spread by inner lens 40 and directed toward outer lens 50. Such light rays are generally indicated by reference letter G. Although the light rays G are shown as stopping at outer lens 50 in FIG. 4C, it is understood that, as described in additional detail herein, some of the light rays will be transmitted and homogenized through the outer lens 50 while other of the light rays may be reflected by the outer lens 50 and directed back toward inner lens 40 and/or other portions of outer lens 50. The light rays generally indicted by reference letter F are reflected off of the reflector 38, directed toward the inner lens 40, internally reflected by the inner lens 40, then directed back toward the reflector 38. The light rays F are again reflected by the reflector 38 toward the inner lens 40, refracted through the inner lens 40, directed toward the outer lens 50, and transmitted and homogenized through the outer lens 50.

Referring now to FIG. 4B, a ray trace is provided of one or more light rays that are emitted from fluorescent light source 18. The light rays pass directly from fluorescent light source 18 through the interior opening 60. The angle of the light rays incident upon the inner lens 40 are such that some are reflected off the interior planar surface of inner lens 40 and/or are internally reflected by inner lens 40 and directed upward toward the reflector 38. Such light rays are generally indicated by reference letter A. Although not shown in FIG. 4B, it is understood that the light rays A will be reflected by reflector 38, then directed toward and refracted through or further reflected by inner lens 40. The angle of some of the light rays emitted directly from fluorescent light source 18 and incident upon the inner lens 40 is such that they are refracted through inner lens 40. Some of those light rays, such as those generally indicated by reference letter B, are directed toward the outer lens 50 and transmitted and homogenized through the outer lens 50. Other of those light rays, such as those generally indicated by reference letter C are directed toward the outer lens 50 and reflected off a surface of the outer lens 50 and/or internally reflected by the outer lens 50. The light rays C are then directed upward toward the inner reflector 40, reflected off and/or internally reflected by the inner reflector 40 back toward the outer reflector 50, and transmitted and homogenized through the outer lens 50. Yet other of the light rays, such as those generally indicated by reference letter D are directed to outer lens 50 and reflected off a surface of the outer lens 50 and/or internally reflected by the outer lens 50. The light rays D are then directed upward toward the inner lens 40, refracted through the inner lens 40, and directed toward the reflector 38. Although not shown in FIG. 4B, it is understood that the light rays D will be reflected by reflector 38, then directed toward and refracted through or further reflected by inner lens 40.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims between parentheses are provided merely for convenience and should not be construed as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to.

What is claimed is:

1. A lighting fixture, comprising:

a main housing supporting a light source and defining a main housing light exit opening;

a main housing lens supported by said main housing across said main housing light exit opening;

an end cap housing coupled to said main housing, said end cap housing supporting an outer arcuate lens, an interior reflector, and an inner lens interposed between said outer arcuate lens and said interior reflector;

said outer arcuate lens having an outer lens first end adjacent said main housing lens and an outer lens second end extending outwardly and upwardly from said outer lens first end;

said inner lens having an inner lens first end adjacent and interior of said outer lens first end and an inner lens first end adjacent and interior of said outer lens second end;

said interior reflector positioned above and spaced from said inner lens;

wherein an interior opening is defined between said end cap housing and said main housing, said interior opening enabling the passage of light from said light source into the space between said inner lens and said interior reflector.

2. The lighting fixture of claim 1, wherein said interior opening is obstruction-free.

3. The lighting fixture of claim 1, wherein said inner lens generally defines a lower extent of said interior opening.

4. The lighting fixture of claim 3, wherein said interior reflector generally defines an upper extent of said interior opening.

5. The lighting fixture of claim 1, wherein substantially all light from said light source incident upon said outer arcuate lens must first pass through said inner lens.

6. The lighting fixture of claim 1, wherein said light source comprises a fluorescent bulb.

7. The lighting fixture of claim 1, wherein said inner lens is at a thirty-five to fifty-five degree angle relative to said main housing lens.

8. The lighting fixture of claim 7, wherein said interior reflector converges toward said inner lens as said interior reflector becomes more proximal said inner lens first end.

9. The lighting fixture of claim 1, wherein said end cap housing is separable from said main housing.

10. A lighting fixture, comprising:

a main housing supporting a light source and defining a main housing light exit opening;

a main housing lens supported by said main housing across said main housing light exit opening;

an end cap housing coupled to said main housing, said end cap housing supporting an outer arcuate lens, an interior reflector, and an inner lens interposed between said outer arcuate lens and said interior reflector;

said outer arcuate lens having an outer lens first end adjacent and substantially aligned with said main housing lens and an outer lens second end extending outwardly and upwardly from said outer lens first end;

wherein any space between said outer arcuate lens and said main housing lens is substantially free of opaque structure;

said inner lens generally extending at approximately a twenty-five to seventy degree angle relative to said main housing lens;

said interior reflector positioned above and spaced from said inner lens;

wherein an interior opening is defined between said end cap housing and said main housing, said interior opening enabling the passage of light from said light source into the space between said inner lens and said interior reflector.

11. The lighting fixture of claim 10, wherein said inner lens and said interior reflector flank said interior opening.

12. The lighting fixture of claim 10, wherein substantially all light from said light source incident upon said outer arcuate lens must first pass through said inner lens.

13. The lighting fixture of claim 12, wherein said inner lens is at a forty to fifty degree angle relative to said main housing lens.

14. The lighting fixture of claim 10, wherein at least one cross section of said outer arcuate lens forms a portion of a parabola.

15. The lighting fixture of claim 10, wherein said first end of said inner lens is substantially atop said first lens of said outer arcuate lens.

16. The lighting fixture of claim 10, further comprising an optical film atop said main housing lens.

17. An end cap for a lighting fixture, comprising:

a housing generally defining a first side, a second side opposite said first side, an outer arcuate lens between said first side and said second side, an interior reflector between said first side and said second side, and an inner lens interposed between said outer arcuate lens and said interior reflector;

said outer arcuate lens having an outer lens first end proximal a connection end of said end cap and an outer lens second end extending outwardly and upwardly from said outer lens first end;

said inner lens being substantially planar and extending from adjacent said outer lens first end to adjacent said outer lens second end;

said reflector positioned above and spaced from majority of said inner lens;

wherein said inner lens and said interior reflector generally flank an interior opening in said connection end of said end cap.

18. The end cap of claim 17, wherein said interior reflector converges toward said inner lens as said interior reflector becomes more distal said interior opening.

19. The end cap of claim 17, wherein said inner lens is substantially atop said first end of said outer lens.

* * * * *